US005774952A

United States Patent [19]

Ito

[11] Patent Number: 5,774,952

[45] Date of Patent: Jul. 7, 1998

[54] SIZE ADJUSTER

[76] Inventor: Yutaka Ito, No. 3-11, 5-chome, Nakagawa, Ikuno-ku, Osaka-shi, Osaka 544, Japan

[21] Appl. No.: 744,496

[22] Filed: Nov. 7, 1996

[30] Foreign Application Priority Data

Aug. 27, 1996 [JP] Japan ..... 8-225048

[51] Int. Cl.[6] ..... A44B 11/20

[52] U.S. Cl. ..... 24/585

[58] Field of Search ..... 24/580–585, 68 R, 24/68 SK

[56] References Cited

U.S. PATENT DOCUMENTS

| | | | |
|---|---|---|---|
| 3,956,802 | 5/1976 | Kanzaka | 24/585 |
| 3,988,812 | 11/1976 | Kanzaka | 24/585 |
| 4,945,616 | 8/1990 | Okano | 24/585 |
| 5,572,747 | 11/1996 | Cheng | 24/585 X |
| 5,579,563 | 12/1996 | Sim | 24/585 |
| 5,588,186 | 12/1996 | Ko | 24/585 |

FOREIGN PATENT DOCUMENTS

| | | | |
|---|---|---|---|
| 150309 | 7/1951 | Australia | 24/585 |
| 598900 | 5/1960 | Canada | 24/585 |

*Primary Examiner*—James R. Brittain
*Attorney, Agent, or Firm*—Armstrong, Westerman Hattori, McLeland & Naughton

[57] ABSTRACT

A size adjustor is provided for adjusting the size of an article requiring size adjustment. The size adjustor includes a flexible belt having a flexible plate attached thereto. The flexible plate has teeth projecting outwardly therefrom and the teeth are arranged at a predetermined pitch. The teeth are arranged in two rows so as to form a channel part between the two rows. The size adjustor also includes an adjustment fixing member. The adjustment fixing member includes an operating plate which is rotatably supported on a main body. The main body includes a bottom plate with a hole therein. Two side plates are perpendicular to the bottom plate and two pivot support arms project upwardly from the side plates. The operating plate has a through hole therein and two perpendicular side walls. The side walls have operating plate supporting holes therein for engagement with the pivot support arms of the main body. A front end of the operating plate has an engaging claw which engages with the teeth projecting outwardly from the flexible belt. A rear end of the operating plate has a spring body part. The spring body part has a tip end which includes a curled portion. The curled portion is of a narrow width so as to fit within the channel part between the two rows of teeth.

2 Claims, 2 Drawing Sheets

SIZE ADJUSTER

BACKGROUND OF THE INVENTION

1. Field of the Invention

This invention relates to a size adjuster used for size adjustment of the length of a shoulder strap of a bag, the head size of a cap or the waist size of a pair of trousers.

2. Description of the Prior Art

A conventional size adjuster of this kind, as disclosed for example in Japanese Utility Model Publication No.H.1-177228, has a construction wherein a flexible band having teeth formed on one side thereof at a predetermined pitch in the form of a rack and having a free end formed by the other end being fixed to a part of an article requiring size adjustment such as the length of a shoulder strap of a bag, the head size of a cap or the waist size of a pair of trousers is passed through an adjustment fixing clasp fixed to another part of the article and having an operating plate pivotally supported on side plates formed projecting perpendicularly from both sides of a bottom plate for fixing and an engaging claw formed at the end of the operating plate is pushed to the side on which the teeth are formed and made to engage with the teeth by a coil spring wound on a shaft on which the operating plate pivots.

However, because the conventional size adjuster described above has a large number of parts such as the bottom plate for fixing on which the side plates are formed, the operating plate, the shaft for the operating plate to pivot on and the spring wound on this pivot shaft, manufacture and assembly of the parts is troublesome and wearing of the teeth tends to occur and the size adjustment fixing function is soon lost and furthermore there has been the problem to be solved of difficulty of use of the operating plate due to lack of twisting rigidity resulting from the flexible band being made extremely thin to enable it to be sewn.

SUMMARY OF THE INVENTION

Accordingly, it is an object of the invention to simplify manufacture and assembly by reducing the number of constituent parts, eliminate loss of size adjustment fixing function caused by wearing of teeth and thereby improve long-term durability and eliminate difficulty of use of the operating plate caused by lack of twisting rigidity of the overall size adjuster and thereby provide a size adjuster having improved quality and good operability.

To achieve the above object and other objects, the invention provides a size adjuster wherein a flexible band 2 having formed on one side thereof two rows of teeth 1 at a predetermined pitch in the form of a rack and having a free end formed by the other end being fixed to a part of an article requiring size adjustment such as the length of a shoulder strap of a bag, the head size of a cap or the waist size of a pair of trousers is passed through an adjustment fixing clasp 7 fixed to another part of the article and having an operating plate 5 pivotally supported on side plates 4 formed projecting perpendicularly from both sides of a bottom plate for fixing 3 having a claw for fixing or a hole for fixing 16, an engaging claw 6 formed at a front end part of the operating plate 5 being pushed and made to engage with the teeth 1 by an elastic spring force, characterized in that a spring body part 9 formed by bending a rear end part 8 of the operating plate 5 to the side of the flexible band 2 on which the teeth 1 are formed and making the tip thereof of a narrow width such that it can fit into a channel part 18 formed by the two rows of teeth 1 and having a curled portion 15 curled toward the rear side of the operating plate 5 is formed integrally with the operating plate 5, and also a central portion of the flexible band 2 on which the teeth 1 are formed is thicker than the periphery.

DETAILED DESCRIPTION OF THE PREFERRED EMBODIMENTS

Figure 1:
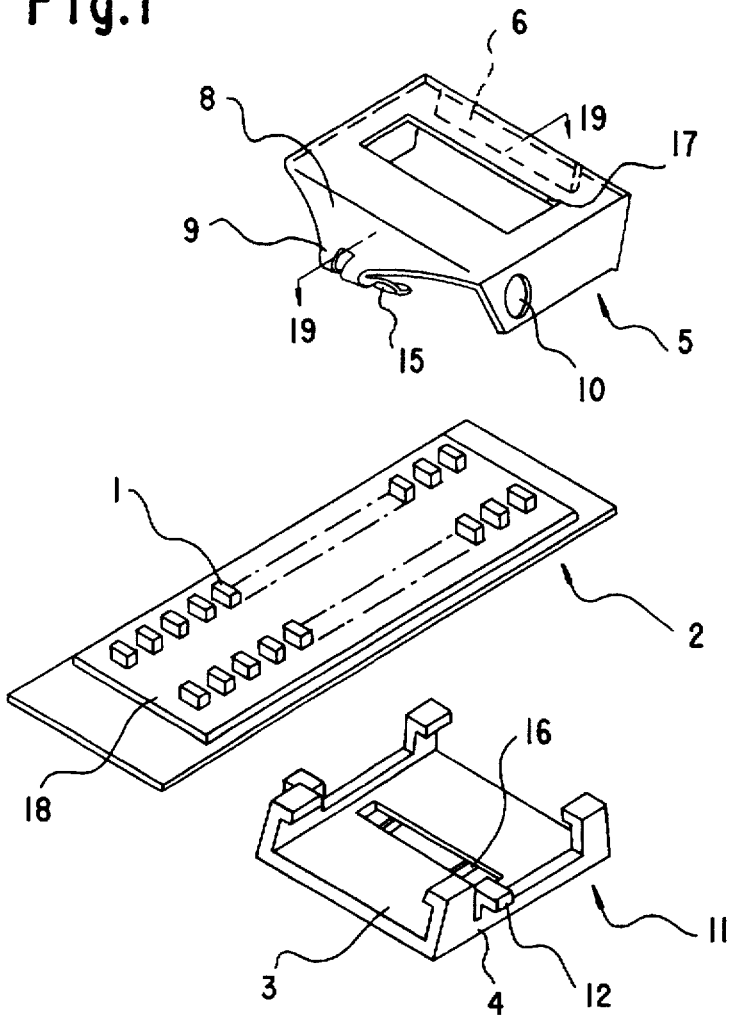
FIG. 1 is an exploded perspective view of a size adjuster according to a preferred embodiment of the invention.
Figure 2:
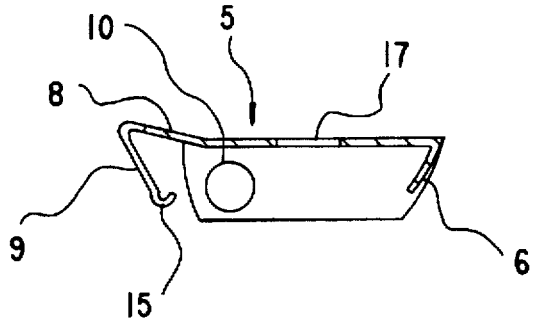
FIG. 2 is a sectional view on the line 19—19 in FIG. 1.
Figure 3:
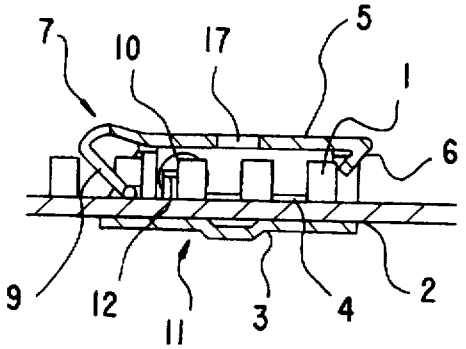
FIG. 3 is a sectional view of the assembled state of the size adjuster of the preferred embodiment.
Figure 4:
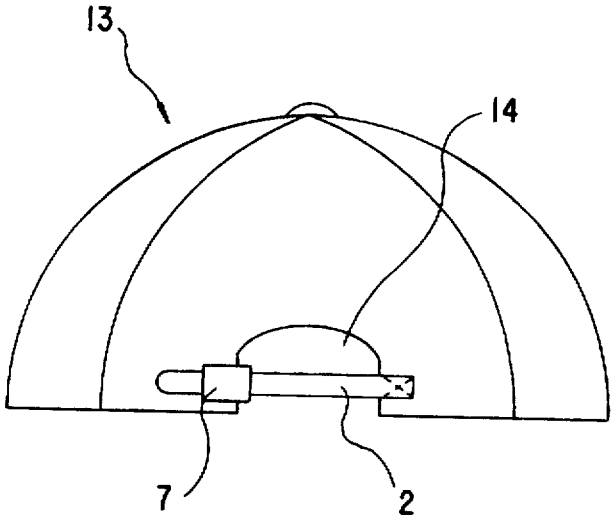
FIG. 4 is a rear view of a cap in which the size adjuster is used for head size adjustment.

FIG. 1 is an exploded perspective view of a size adjuster according to a preferred embodiment of the invention, FIG. 2 is a sectional view on the line 19—19 in FIG. 1, FIG. 3 is a sectional view of the assembled state of the size adjuster, and FIG. 4 is a rear view of a cap in which the size adjuster is used for head size adjustment.

A size adjuster according to this preferred embodiment is made up of a synthetic resin flexible band 2 and a metal adjustment fixing clasp 7 comprising a metal spring plate; the flexible band 2 has two rows of teeth 1 formed on one side thereof at a predetermined pitch in the form of a rack with a channel-shaped passage provided between the two rows, and the adjustment fixing clasp 7 is made up of a fixing clasp main body 11 having perpendicularly formed side plates 4 from which horizontally project pivot support arms 12 supported as pivot centers which side plates 4 are formed on both sides of a bottom plate for fixing 3 having a hole for fixing 16 and an operating plate 5 having an engaging claw 6 formed at the rear end part thereof and having operating plate supporting holes 10 provided in both sides and made a metal spring plate formed integrally with a spring body part 9 formed by bending a rear end part 8 to the side of the flexible band 2 on which the teeth 1 are formed and making the tip thereof of a narrow width such that it can fit into the channel part 18 and having a curled portion 15 curled toward the rear side, and a through hole 17 for inserting a fastening tool is provided in the operating plate 5.

In the size adjuster described above, the fixing clasp main body 11 and the operating plate 5 constituting the adjustment fixing clasp 7 are assembled by the pivot support arms 12 provided on the side plates 4 of the fixing clasp main body 11 being passed through the operating plate supporting holes 10 provided in both sides of the operating plate 5, and as a result of this the spring body part 9 spring-urges the rear end part 8 of the operating plate 5 upward.

An example of how the size adjuster described above is used is shown in FIG. 4. In this example, one end of the flexible band 2 is fixed to one edge of a cutaway part for adjustment 14 formed in the rear of a cap 13 and the adjustment fixing clasp 7 is fixed to the other edge using a rivet or the like, and the free end of the flexible band 2 is passed between the fixing clasp main body 11 and the operating plate 5 of the adjustment fixing clasp 7 and the engaging claw 6 is engaged with the teeth 1.

A size adjuster according to the invention is most usually used for size adjustment of trousers and skirts and the like, and in these cases is used in the same way as that described above.

According to the construction of the size adjuster of the invention described above, because the width of the spring body part 9 is a narrow width such that it can fit into the channel part 18 it is possible to move the adjustment fixing clasp 7 along the flexible band 2 without the spring body part 9 and the teeth 1 making contact and during size adjustment the size adjuster is smooth and its operability is improved and it is possible to prevent wear of the teeth 1 and as a result the size adjusting function is not lost and the durability is improved. Also, because the operating plate 5 and the spring body part 9 are formed integrally by bending, there are few parts and it is possible to make manufacture and assembly of the parts simple and provide a size adjuster cheaply.

Furthermore, when in the flexible band 2 the central portion on which the teeth 1 are formed is made thicker than the periphery, the twisting rigidity increases and shortening of life due to wearing of the channel part is eliminated, and using the thin periphery part it is possible to sew the flexible band 2 without breaking the needle and the work of sewing the size adjuster to an article such as a pair of trousers becomes easy and also it is possible to eliminate poor operation and difficulty of handling of the operating plate.

What is claimed is:

1. A size adjustor for an article requiring size adjustment comprising:

a flexible band having first and second surfaces and first and second ends, wherein said first end is a free end and said second end is fixed to a first part of said article requiring size adjustment;

two rows of teeth projecting outwardly from said first surface of said flexible band, wherein each tooth of said two rows of teeth is at a predetermined pitch; and an adjustment fixing means for engaging said teeth of said flexible band to adjust a size of said article requiring size adjustment, wherein said adjustment fixing means is fixed to a second part of said article requiring size adjustment and said adjustment fixing means includes an operating plate pivotally supported on side plates, said side plates projecting perpendicularly from both sides of a bottom plate of a adjustment fixing means main body, said operating plate having an engaging claw formed at a front end part thereof to engage said teeth of said flexible belt, and said operating plate includes a spring body part at a rear end part thereof, said spring body part having a tip being of a narrow width such that said tip care fit into a channel part formed between said two rows of teeth and said spring body part having a curled portion which is curled toward a rear side of said operating plate and which is formed integrally with said operating plate.

2. The size adjustor according to claim 1, wherein a periphery of said flexible band is of such a thickness that said periphery of said flexible band can be sewn through and a central portion of said flexible band, on which said teeth are formed, is thicker than said periphery of said flexible band.

* * * * *